US006068453A

United States Patent [19]

Ahn et al.

[11] Patent Number: 6,068,453

[45] Date of Patent: May 30, 2000

[54] RECIPROCATING PISTON TYPE REFRIGERANT COMPRESSOR

[75] Inventors: Hyu Nam Ahn; Kweon Soo Lim; Min Joo Lee, all of Taejon, Rep. of Korea

[73] Assignee: Halla Climate Control Corp., Taejon, Rep. of Korea

[21] Appl. No.: 09/106,031

[22] Filed: Jun. 29, 1998

[30] Foreign Application Priority Data

Jun. 30, 1997 [KR] Rep. of Korea ..... 97-30133
Apr. 23, 1998 [KR] Rep. of Korea ..... 98-14531

[51] Int. Cl.[7] ..... F04B 39/00

[52] U.S. Cl. ..... 417/269; 417/312

[58] Field of Search ..... 417/269, 312

[56] References Cited

U.S. PATENT DOCUMENTS 4,929,157 5/1990 Steele et al. ..... 417/312
5,702,236 12/1997 Ikeda ..... 417/269
5,899,670 5/1999 Ikeda et al. ..... 417/312

*Primary Examiner*—William Doerrler
*Attorney, Agent, or Firm*—Ladas & Parry

[57] ABSTRACT

A reciprocating piston type compressor comprises a cylinder block assembly, a drive shaft rotating together with a swash plate, a plurality of cylinder bores, a plurality of reciprocating pistons fitted within the cylinder bores, front and rear valve plates, front and rear suction and discharge valves, and front and rear housings. The front housing has a suction chamber for a refrigerant gas to be compressed and a discharge chamber for the compressed refrigerant gas in response to reciprocation of the pistons. The rear housing has a suction chamber for a refrigerant gas to be compressed, a discharge chamber for the compressed refrigerant gas, and an outlet chamber for delivering the compressed refrigerant gas carried therein from the discharge chamber of the front housing via a discharge passageway formed in the cylinder block assembly toward an external climate control system. A discharge conduit is formed in the discharge chamber of the rear housing to be orthogonally communicated with the outlet chamber. A sum of volumes of the discharge chamber of the front housing and the discharge passageway is the same as a sum of volumes of the discharge chamber of the rear housing and the discharge conduit. The discharge conduit extends to about half of the distance between a point on an interior surface of an inner wall of the rear hosusing and an opposite point on the interior surface of the inner wall.

4 Claims, 12 Drawing Sheets

RECIPROCATING PISTON TYPE REFRIGERANT COMPRESSOR

BACKGROUND OF THE INVENTION

1. Field of the Invention

The present invention relates to a reciprocating piston type refrigerant compressor adapted for being used in an airconditioning system of an automobile, and more particularly, it relates to a multi-piston swash plate type refrigerant compressor provided with a housing in which damping of discharge gas pulsation is achieved and with a simple construction of the compressor in which separate parts are not needed for sealing a discharge passageway.

2. Description of the Related Art

For aiding in understanding of the present invention, reference is made firstly to FIGS. 1, 2 and 3 showing a conventional reciprocating piston type refrigerant compressor. FIG. 1 is a longitudinal cross-sectional view, and FIGS. 2 and 3 show front and rear housings, respectively. The compressor is provided with front and rear cylinder blocks 1 and 1*a* which are axially connected to one another so as to form an integral cylinder block assembly. Front and rear ends of the cylinder block assembly are closed by front and rear housings 8 and 9, via front and rear valve plates 10 and 11. The front and rear cylinder blocks 1 and 1*a*, front and rear valve plates 10 and 11 and front and rear housings 8 and 9 are tightly held by through-bolt(not shown) which are inserted into coaxial through-bores 12 and 12*a*. The combined cylinder blocks 1 and 1*a* are further provided with an axial central bore including coaxial front and rear bores 7 and 7*a* formed in the front and rear cylinder blocks 1 and 1*a*, respectively. The central bore supports an drive shaft 14, via metal bearings 7*b* and 7*c*. Lubrication oil is provided with the cylinder blocks 1 and 1*a* through oil supplying passageway 13 and 13*a*.

A plurality of cylinder bores 2, the same number of front and rear cylinder bores, are formed around a longitudinal axis of the combined cylinder blocks 1 and 1*a*. Double-headed pistons 4 are received in the cylinder bores 2 and engage a with a swash plate 3 via semi-circular shoes 6.

The cylinder block assembly has a swash plate chamber 5 formed therein at the juncture of the cylinder blocks 1 and 1*a*, and the swash plate 3 is arranged in the swash plate chamber 5 and mounted on the drive shaft 14. The swash plate 3 is rotated together with the drive shaft 14 which in turn is rotated according to rotation of an electromagnetic clutch 14*a*, and therefore the double-headed pistons 4 are reciprocated in the cylinder bores 2.

The front and rear housings 8 and 9 are provided with inner front and rear discharge chambers 16 and 17, and radially outer front and rear suction chambers 23 and 24 formed therein, respectively. The front and rear valve plates 10 and 11 have suction ports 27 and 28 bored therein, respectively, so as to provide fluid communication between the suction chambers 23 and 24 and the respective cylinder bores 2. The front and rear valve plates 10 and 11 also have discharge ports 21 and 22 bored therein, respectively, so as to provide fluid communication between the discharge chambers 16 and 17 and the respective cylinder bores 2.

The suction ports 27 and 28 are closed by front and rear suction valves 25 and 26 in the form of reed-valves arranged to make contact with inner faces of the front and rear valve plates 10 and 11. Similarly, the discharge ports 21 and 22 are closed by front and rear discharge valves 19 and 20 in the form of reed-valves arranged to make contact with the outer faces of the front and rear valve plates 10 and 11. The suction and discharge valves 25, 26, 19, and 20 can be moved away from the corresponding suction and discharge ports 27, 28, 21, and 22 by the compression stroke of the double-headed pistons 4 so as to open the respective suction and discharge ports.

Certain clearances 15 and 15*a* are formed between the outer peripheral wall of the combined cylinder blocks 1 and 1*a* and the inner peripheral wall of the front and rear housings 8 and 9 assembled, and communication holes (not shown) are formed in the cylinder blocks 1 and 1*a* in order to provide fluid communication between the swash plate chamber 5 and the clearances 15 and 15*a*. The refrigerant gas is introduced into an inlet chamber 43 (FIG. 3) through a refrigerant inlet port (not shown) from the external air-conditioning system, and then is delivered into the swash plate chamber 5 through openings (not shown) and the communication holes formed in the cylinder blocks 1 and 1*a*, the openings being formed in a valve assembly including the valve plate 11 and the suction and discharge valves 26 and 20. The refrigerant gas introduced into the swash plate chamber 5 flows into the suction chambers 23 and 24 via suction passageways axially formed in the cylinder blocks 1 and 1*a*. Then, the refrigerant gas passes into the respective cylinder bores 2 due to the suction operation of the respective double-headed pistons 4. The refrigerant gas in the respective cylinder bores 2 is discharged from the cylinder bores 2 into the discharge chambers 16 and 17. The compressed refrigerant gas flowing into the discharge chamber 16 in the front housing 8 is carried into the discharge room 41 in the rear housing 9, via an extended discharge port 40 and discharge passageways 39 and 39*a* coaxially formed in the cylinder blocks 1 and 1*a*. The refrigerant gas into the discharge room 41 and the refrigerant gas coming from the discharge chamber 17 in the rear housing 9 through a discharge passageway 37 are collected in the discharge room 41. Then, the compressed refrigerant gas is delivered toward the external airconditioning system through an outlet port 42 of the compressor.

An O-ring 29 is provided to prevent leakage of the refrigerant gas from the junction of the combined front and rear housings 8 and 9, and mounting lugs 32 are provided for mounting the compressor to the framework of an automobile chasis.

As depicted in FIGS. 2 and 3, in the front and rear housings 8 and 9, axial bores 34 and 34*a* and a plurality of walls 35 and 36 extending from bosses 34*b* and 34*c* are formed, respectively, so as to provide support for the valve assembly. An inner wall 35*a* of the front housing 8 divides the front suction and discharge chambers 23 and 16, and the rear suction and discharge chambers 24 and 17 are formed in the rear housing 9 by an inner wall 36*a* and an outer wall 36*b*. Between the inner and outer walls 36*a* and 36*b* of the rear housing 9, a discharge passageway 37 is provided. A communication path 38 in the rear housing 9 provides fluid communication between the discharge chamber 17 and the discharge passageway 37. Therefore, the refrigerant gas discharged into the discharge chamber 17 of the rear housing 9 is delivered toward the external airconditioning system through the outlet port 42 formed at the discharge room 41, via the communication path 38 and the discharge passageway 37. Also, the compressed refrigerant gas discharged into the discharge chamber 16 of the front housing 8 is carried into the discharge room 41 of the rear housing 9 via the extended discharge port 40 and the discharge passageways 39 and 39*a*, and then delivered toward the external airconditioning system through the outlet port 42.

With the above described swash plate type compressor, since the discharge passageway 37 to discharge the compressed refrigerant gas of the rear housing 9 toward the external airconditioning system is formed outside the discharge chamber 17 along the inner wall 36 of the discharge chamber 17, that is, formed extending with a certain length between the discharge chamber 17 and the suction chamber 24, difficulty has been met in closing the discharge passageway 37 by anti-leaking means such as a gasket. Namely, the upper opening of the discharge passageway 37 must be closed by the separate gasket, because the upper opening is not covered by the rear valve plate 11 and the rear suction and discharge valves 26 and 20. This requires complexity in construction of the compressor. The narrow and long semicircular structure of the discharge passageway 37 becomes obstacle in refrigerant flow, and eventually creates pressure loss.

Further, the discharge passageway 37 occupies a certain area of the suction chamber 24 so as to reduce the volume of the suction chamber 24. The outer wall 36*b*, which defines boundary between the suction chamber 24 and the discharge passageway 37, covers partially the suction ports which are placed above the suction passageway 37 among the suction ports of the valve plate 11, and accordingly, the suction operation of the refrigerant gas between the swash plate chamber 5 and the suction chamber 24 of the rear housing 9 is subject to a large resistance.

Moreover, where any design modifications on the structure of the discharge passageway 37 occur to improve it, the parts such as a gasket relating to the discharge passageway 37 must also be changed, and this is not desirable from the viewpoint of costs.

SUMMARY OF THE INVENTION

An object of the present invention is therefore to provide a reciprocating piston type refrigerant compressor having a simplified discharge structure by, inside a discharge chamber, forming a discharge passageway which is for delivering the compressed refrigerant gas from a discharge chamber of a rear housing toward an external airconditioning system.

According to this characteristic of the present invention, design modification on the discharge chamber of the compressor is easy, and pressure loss which may occur at suction and discharge is reduced due to smooth suction and discharge of the refrigerant gas among the elements of the compressor.

Another object of the present invention is to provide a reciprocating piston type compressor having a discharge structure in which a noise due to gas pulsation is effectively removed without any separate damping unit for gas pulsation.

This latter object of the present invention is achieved by maintaining the volumes of the discharge chambers of the front and rear housings identical and making two waves, one discharge gas pulsation wave in a discharge chamber of a front housing, the other discharge gas pulsation wave in a discharge chamber of a rear housing, have phase difference by almost 180°, so as to almost cancel each other.

In accordance with the present invention, there is provided a reciprocating piston type compressor comprising:

a cylinder block having therein a central shaft bore and a plurality of cylinder bores arranged around said shaft bore;

a drive shaft rotatably supported in said shaft bore and supporting thereon a swash plate so as to be rotated together with said swash plate;

a plurality of pistons operatively engaged with said swash plate and reciprocating in said plurality of cylinder bores, respectively, to implement suction, compression, and discharge of a refrigerant gas in response to rotation of said drive shaft and said swash plate;

front and rear valve plate means for covering the ends of said cylinder bores at both ends of said cylinder block and having a plurality of suction ports and a plurality of discharge ports for sucking the refrigerant gas into and discharging the refrigerant gas from said cylinder bores, respectively;

a front housing closing one end of said cylinder block, said front housing having an inner wall defining a front discharge chamber for receiving compressed refrigerant gas discharged from said plurality of cylinder bores through said plurality of discharge ports formed in said front valve plate means, and said inner wall and an interior surface defining a front suction chamber for receiving the refrigerant gas to be compressed through said plurality of suction ports formed in said front valve plate means;

a rear housing closing the other end of said cylinder block, said rear housing having an inner wall defining a rear discharge chamber for receiving compressed refrigerant gas discharged from said plurality of cylinder bores through said plurality of discharge ports formed in said rear valve plate means, said inner wall and an interior surface defining a rear suction chamber for receiving the refrigerant gas to be compressed through said plurality of suction ports formed in said rear valve plate means, a discharge conduit placed within said rear discharge chamber for delivering the compressed refrigerant gas discharged into said rear discharge chamber, and an outlet chamber for receiving and discharging the compressed refrigerant gas carried from said discharge chamber of said front housing through a discharge passageway formed in said cylinder block and communicated with said discharge conduit;

front suction and discharge valve means for providing a refrigerant gas communication between said front suction and discharge chambers of said front housing and said cylinder bores, said front suction and discharge valve means having a plurality of movable suction and discharge reed valves and arranged between said cylinder block and said front valve plate means; and rear suction and discharge valve means for providing a refrigerant gas communication between said rear suction and discharge chambers of said rear housing and said cylinder bores, said rear suction and discharge valve means having a plurality of movable suction and discharge reed valves and arranged between said cylinder block and said rear valve plate means.

The above and other objects, features and advantages of the present invention will be made more apparent from the following description with reference to the accompanying drawings.

DESCRIPTION OF THE PREFERRED EMBODIMENTS

Figure 4:
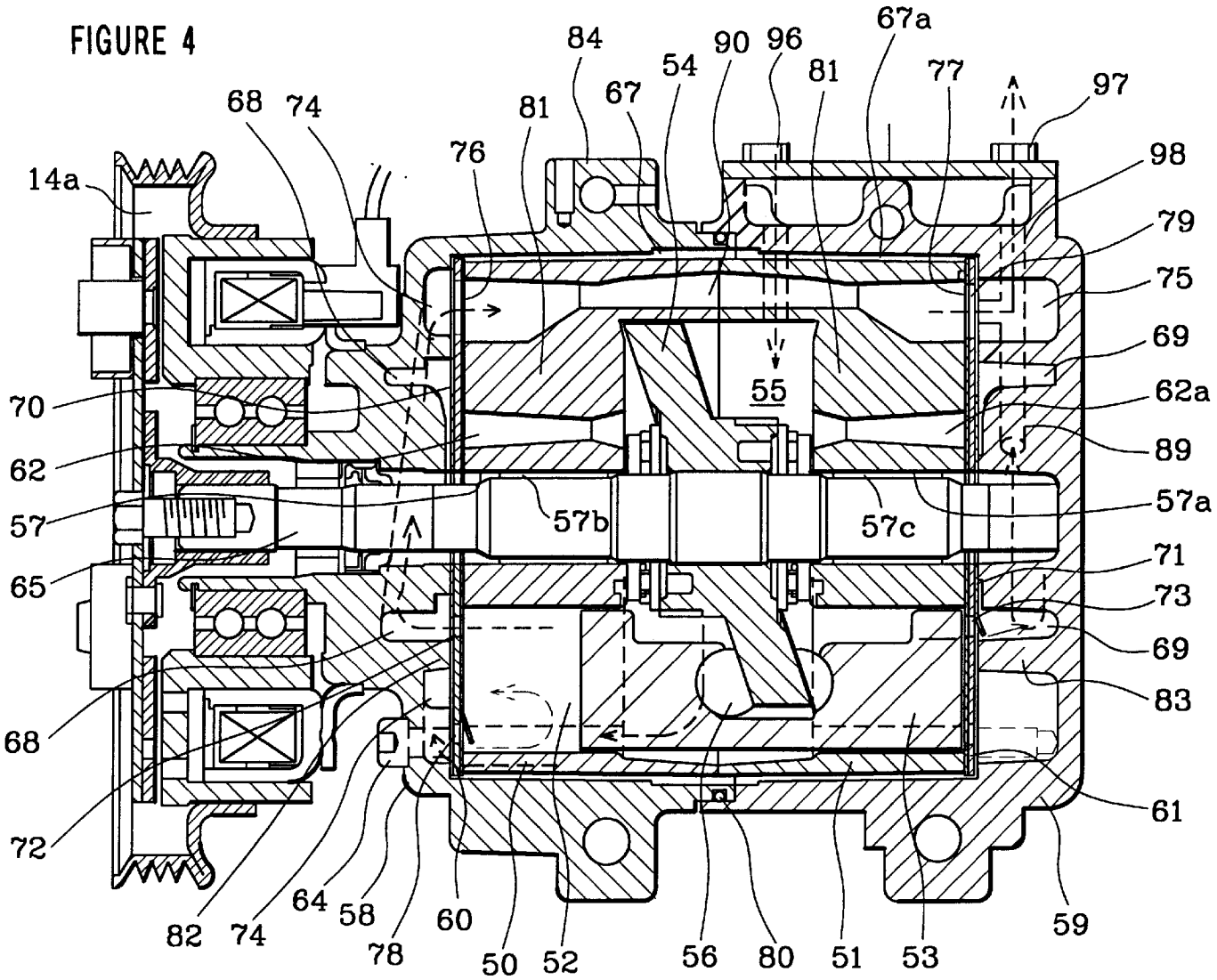
FIG. 4 is a longitudinal cross-sectional view of a reciprocating piston type compressor having a simple and effective noise-removing structure according to the present invention.
Figure 5:
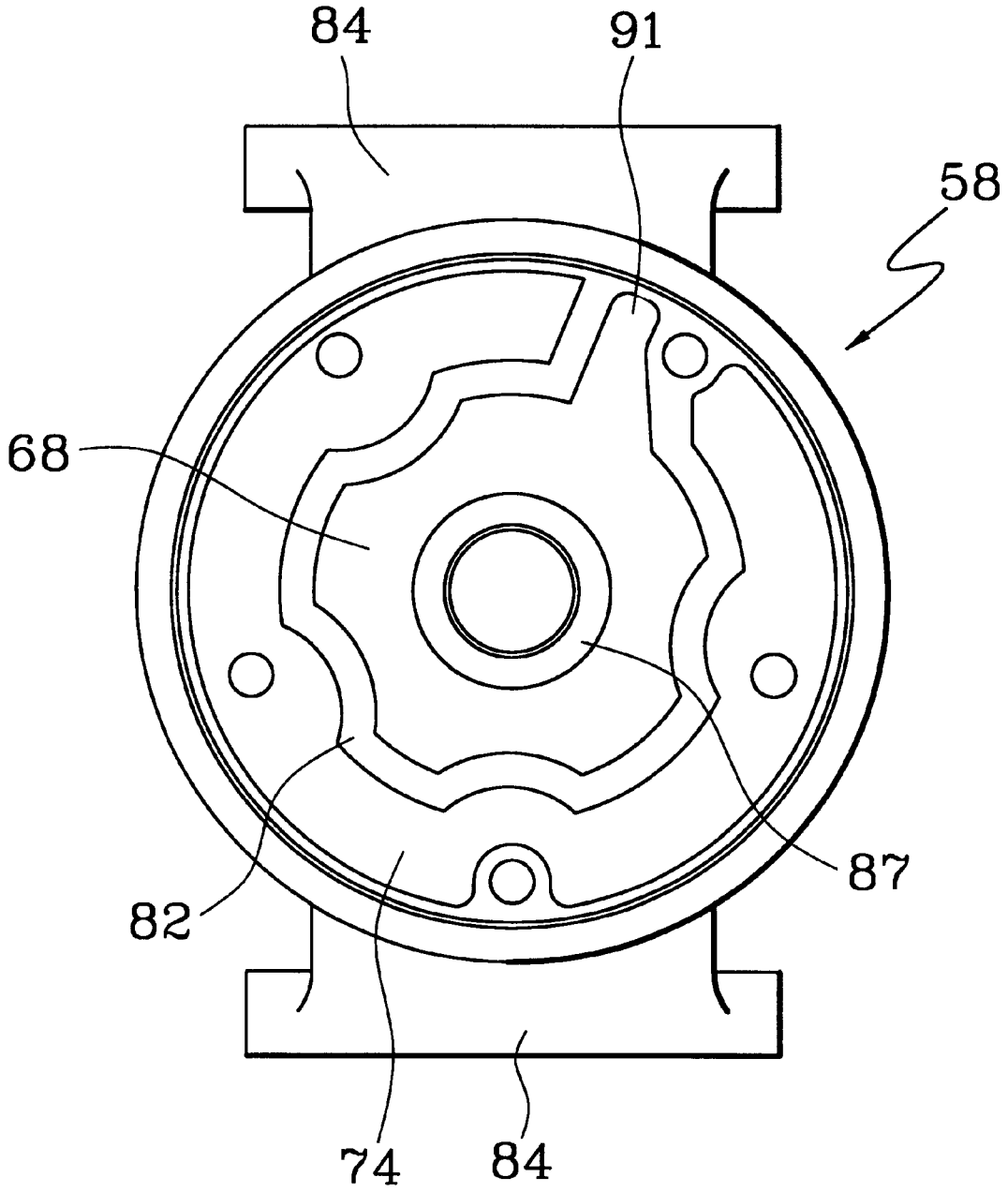
FIG. 5 is a front view of a front housing of the compressor of FIG. 4.
Figure 6:
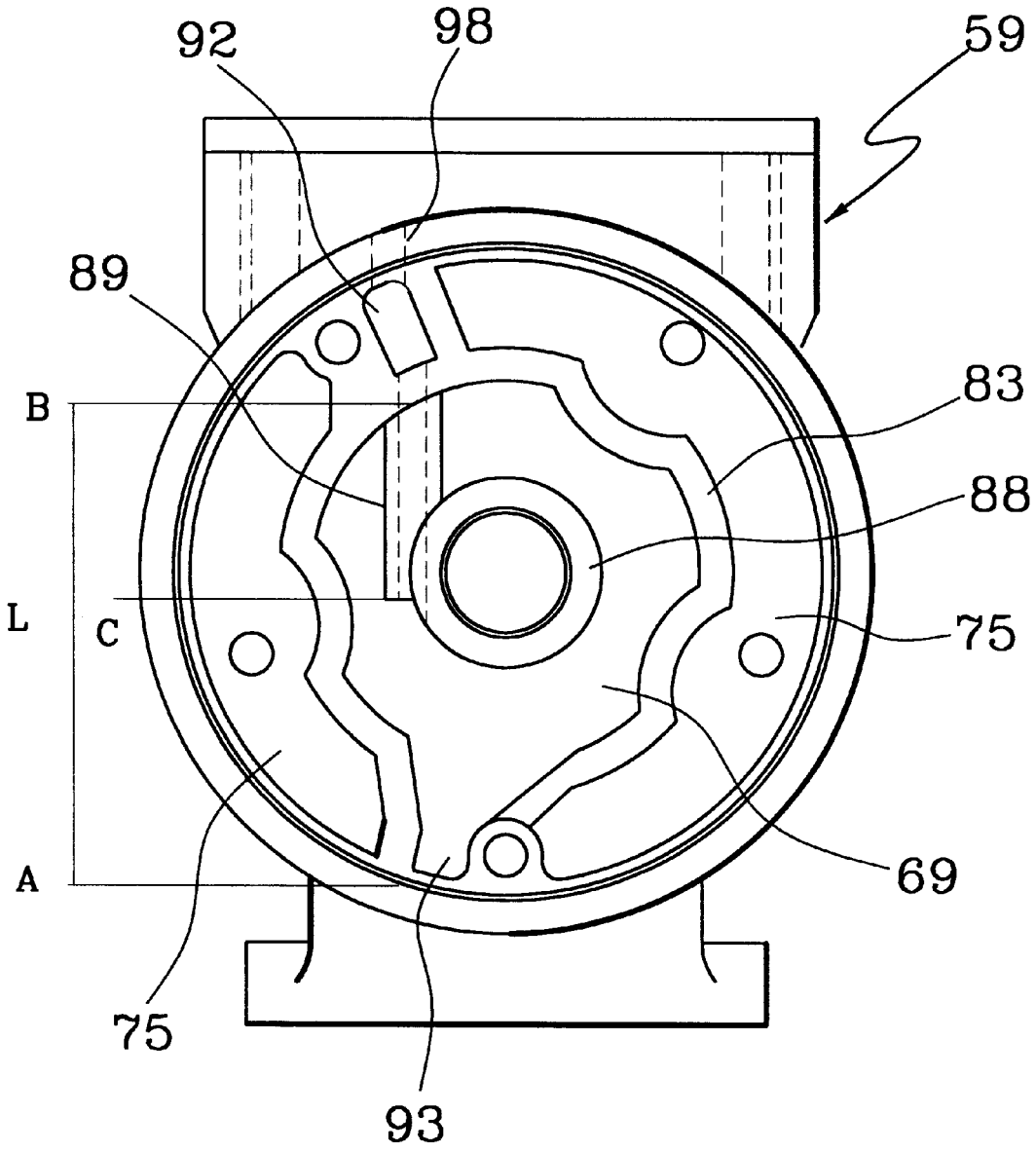
FIG. 6 is a front view of a rear housing of the compressor of FIG. 4.

Referring to FIGS. 4, 5 and 6, a reciprocating piston type compressor is provided with front and rear cylinder blocks 50 and 51 axially combined together so as to form a cylinder block assembly which is accommodated in front and rear housings 58 and 59. The ends of the axially combined front and rear cylinder blocks 50 and 51 are closed by the front and rear housings 58 and 59 via front and rear valve plates 60 and 61. The front and rear cylinder blocks 50 and 51, front and rear valve plates 60 and 61, and front and rear housings 58 and 59 are tightly combined by axial long screw bolts 64 which are inserted into coaxial through-bores 62 and 62*a*. The combined cylinder blocks 50 and 51 are further provided with axial central bores 57 and 57*a* through which an axial drive shaft 65 is inserted so as to be rotatably supported by a pair of metal bearings 57*b* and 57*c*.

The combined cylinder blocks 50 and 51 have a plurality of pairs of axial cylinder bores 52, i.e., five front cylinder bores substantially equidistantly arranged around the axis of rotation of the drive shaft 65. Five double-headed pistons 53 are axially slidably fitted in the cylinder bores 52, and engaged with a swash plate 54 via semi-circular shoes 56. The pistons 53 are reciprocated by the swash plate 54 in response to the rotation of the drive shaft 65 which is rotated by an electromagnetic clutch 14*a*.

The combined cylinder blocks 50 and 51 are provided with a swash plate chamber 55 formed at a position corresponding to the connecting portion of the front and rear cylinder blocks 50 and 51. The swash plate 54 is mounted on the middle portion of the drive shaft 65 and received in the swash plate chamber 55 so as to be rotated with the drive shaft 65. Rotation of the swash plate 54 makes the pistons 53 to be reciprocated in the respective cylinder bores 52 so as to carry out suction, compression, and discharge of the refrigerant gas.

The front and rear housings 58 and 59 are provided with inner discharge chambers 68 and 69, and outer suction chambers 74 and 75, respectively. The outer suction chambers 74 and 75 are arranged radially outside the inner discharge chambers 68 and 69. The front and rear valve plates 60 and 61 have suction ports 78 and 79 bored therein, respectively, so as to provide a fluid communication between the suction chambers 74 and 75 and the respective cylinder bores 52. The front and rear valve plates 60 and 61 also have discharge ports 72 and 73 bored therein, respectively, so as to provide a fluid communication between the discharge chambers 68 and 69 and the respective cylinder bores 52. Namely, the suction ports 78 and 79 allow low pressure refrigerant gas to enter the respective cylinder bores 52 to be compressed by the compressing stroke of the double-headed pistions 53. The discharge ports 72 and 73 allow high pressure compressed refrigerant gas to be discharged from the cylinder bores 52 into the discharge chambers 68 and 69 by the compressing stroke of the double-headed pistons 53.

Figure 7:
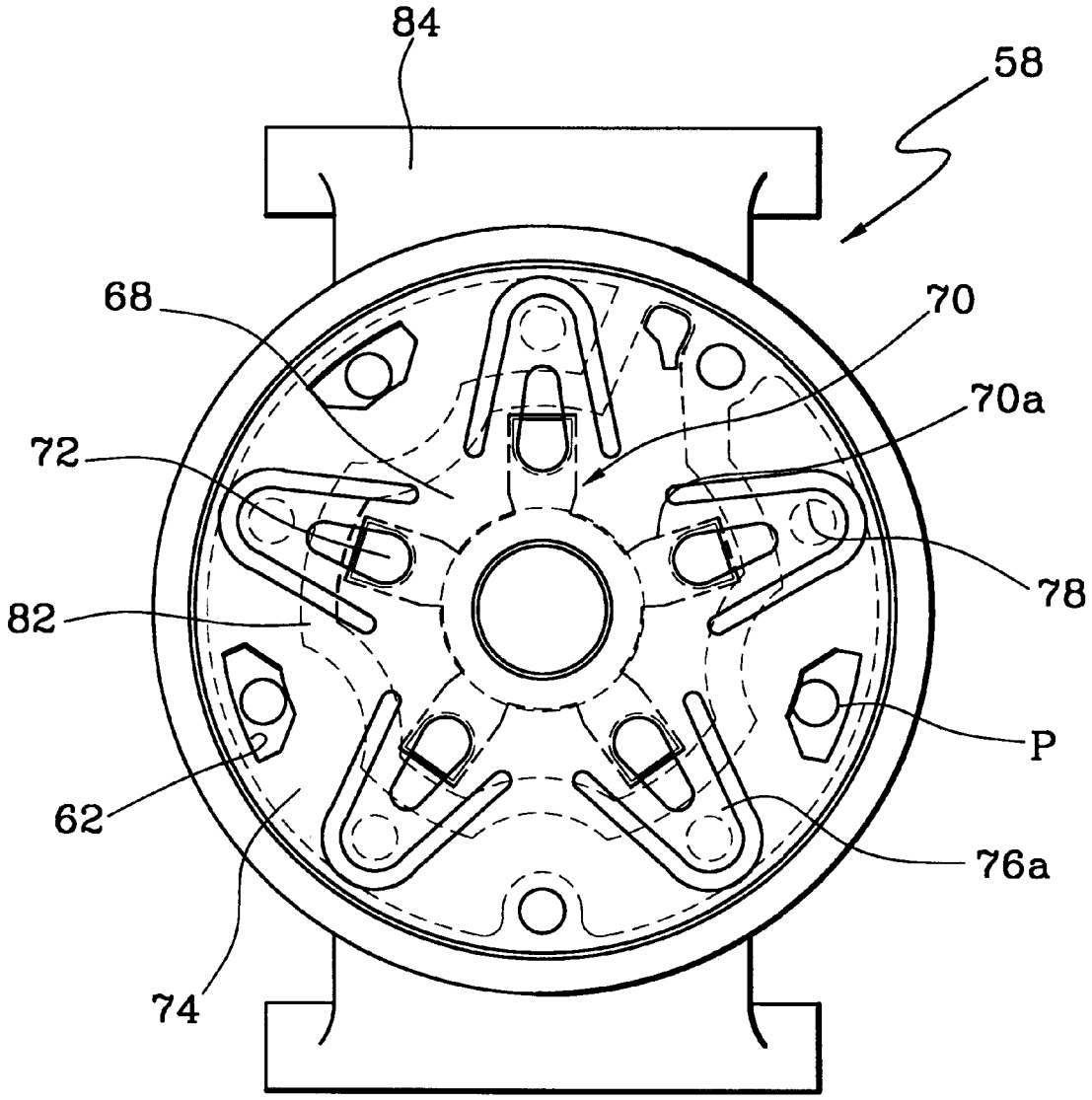
FIG. 7 is a front view of a front housing having a valve plate, and suction and discharge valves of the compressor of FIG. 4.
Figure 8:
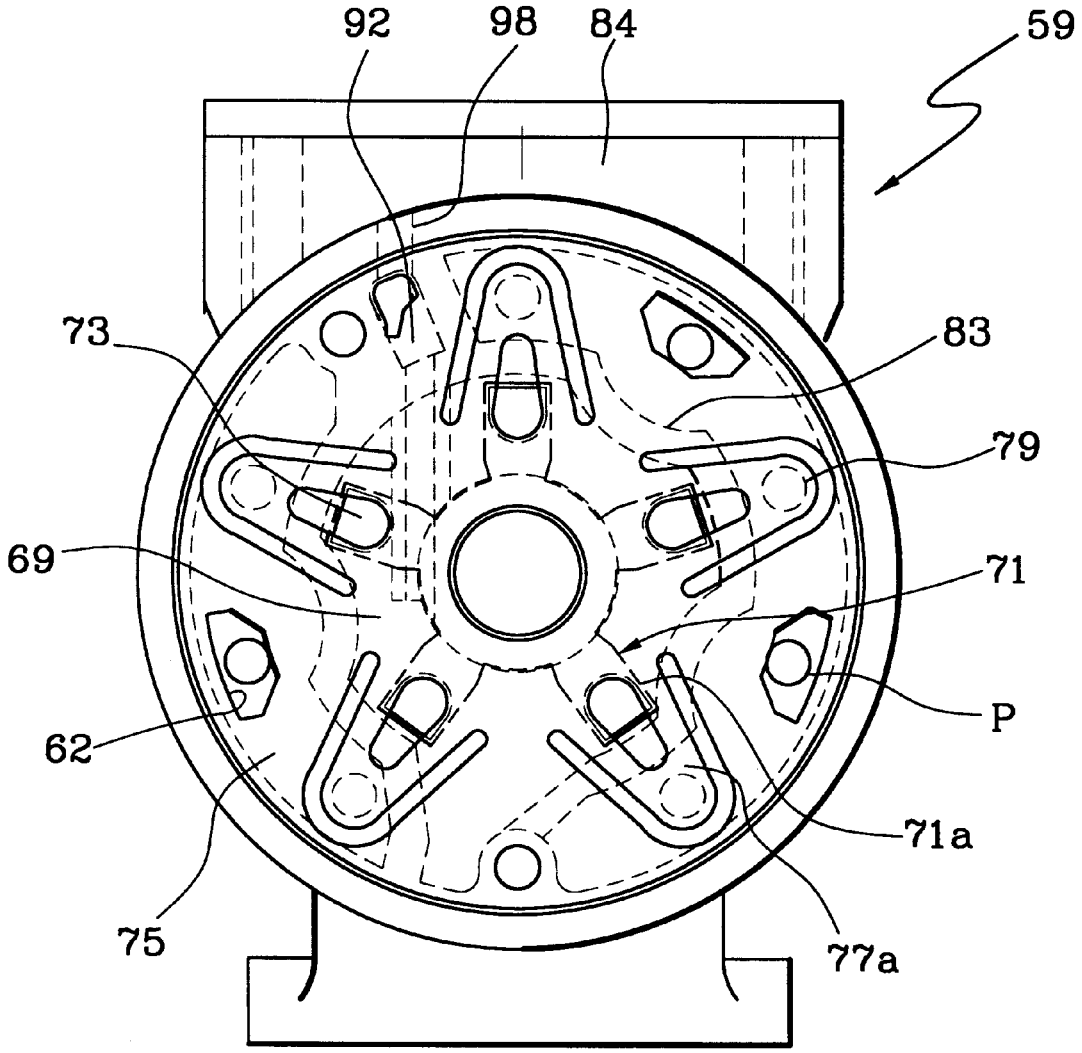
FIG. 8 is a front view of a rear housing having a valve plate, and suction and discharge valves of the compressor of FIG. 4.

The suction ports 78 and 79 of the front and rear valve plates 60 and 61 are closed, respectively, by front and rear suction valves 76 and 77 having reed-valves 76*a* and 77*a* (FIGS. 7 and 8) arranged to be in contact with inner faces of the front and rear valve plates 60 and 61, i.e., the faces confronting the ends of the combined cylinder blocks 50 and 51. Similarly, the discharge ports 72 and 73 of the front and rear valve plates 60 and 61 are closed, respectively, by front and rear discharge valves 70 and 71 having reed-valves 70*a* and 71*a* (FIGS. 7 and 8) to be in contact with the outer faces of the front and rear valve plates 60 and 61, i.e., the face confronting the front and rear housings 58 and 59. In response to the reciprocation of the double-headed pistons 53, reed-valves 76*a*, 77*a*, 70*a* and 71*a* of the suction and discharge valves 76, 77, 70 and 71 are moved away from the suction and discharge ports 78, 79, 72 and 73 so as to open the respective ports.

Figure 1:
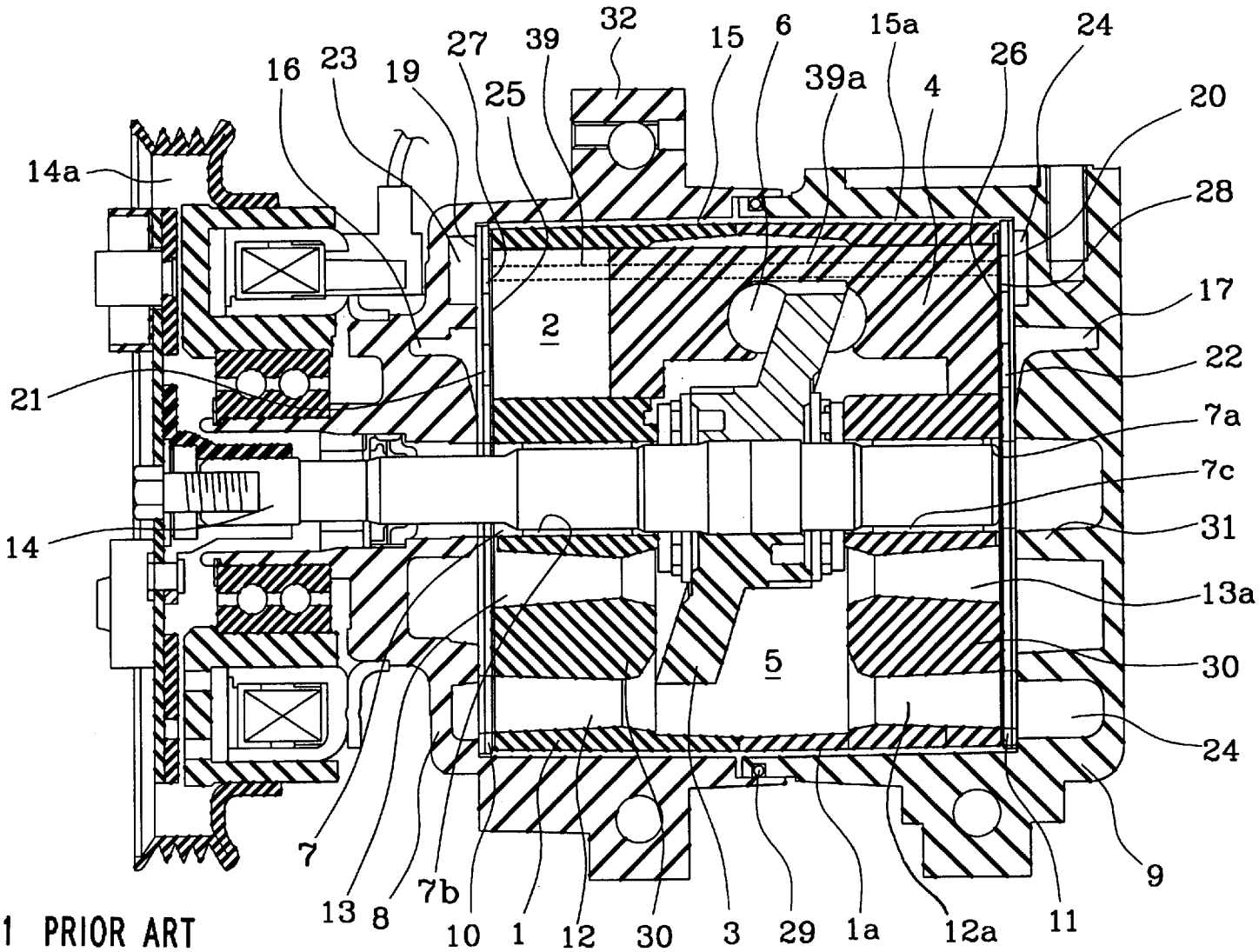
FIGURE 1 PRIOR ART
FIG. 1 is a longitudinal cross-sectional view of the prior art compressor.
Figure 2:
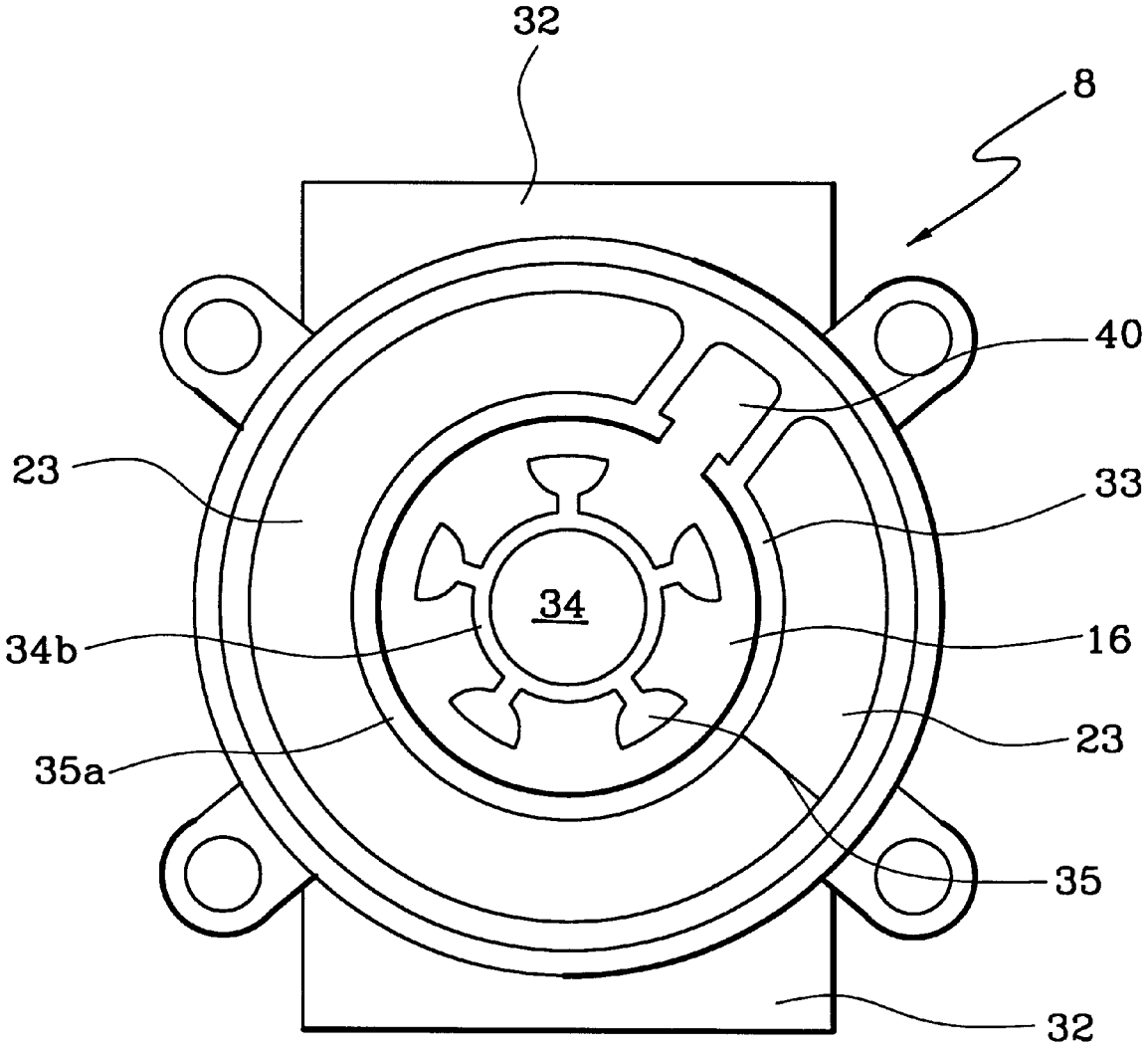
FIGURE 2 PRIOR ART
FIG. 2 is a front view of a front housing of the prior art compressor as show in FIG. 1.
Figure 3:
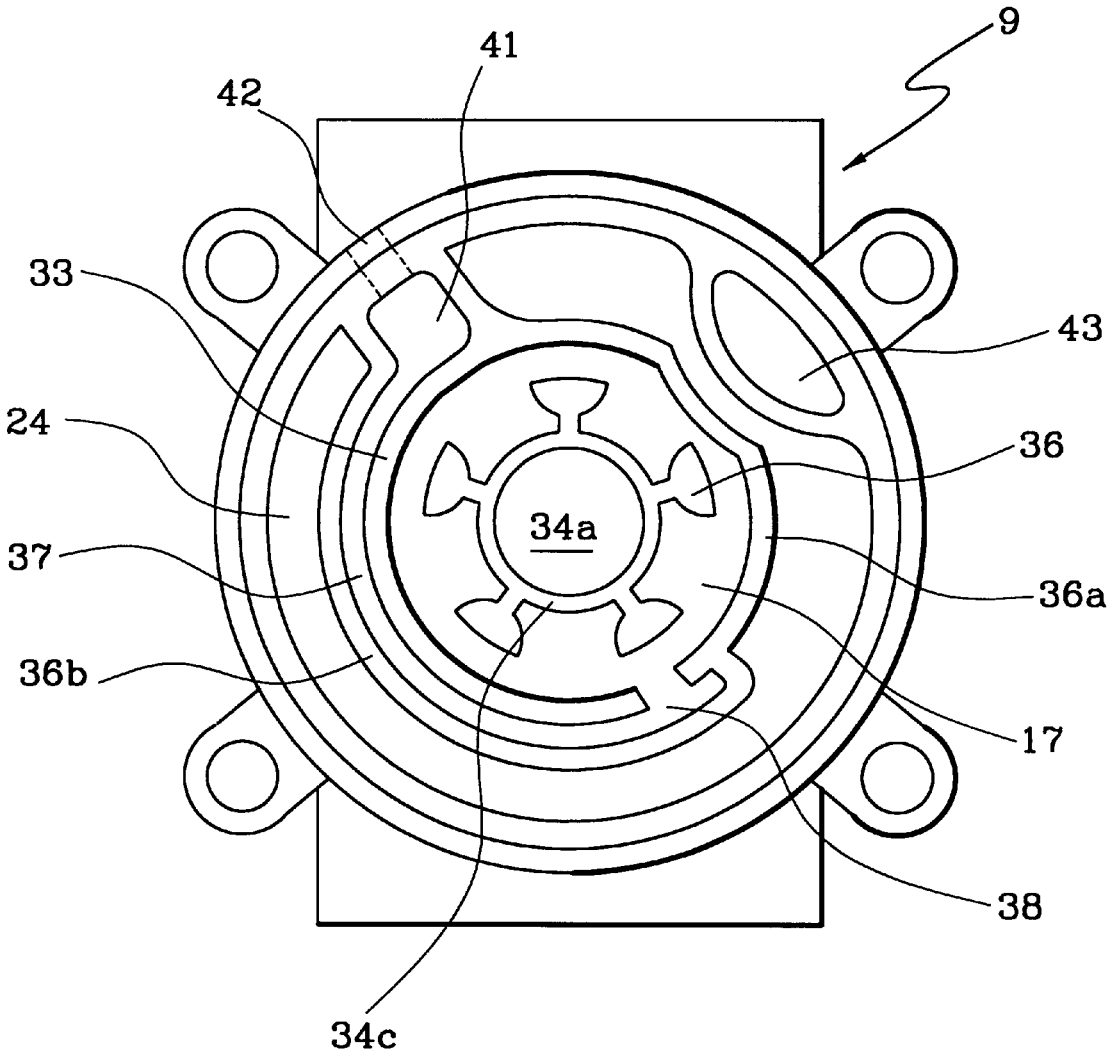
FIGURE 3 PRIOR ART
FIG. 3 is a front view of a rear housing of the prior art compressor as shown in FIG. 1.

Referring to FIGS. 4 to 8, clearances 67 and 67*a* are maintained between the exterior peripheral faces of the combined cylinder blocks 50 and 51 and the interior peripheral faces of the front and rear housings 58 and 59. The combined cylinder blocks 50 and 51 are provided with cut-away portions (not shown) formed in the outer wall of the combined cylinder blocks 50 and 51 and positioned above the swash plate chamber 55 so as to provide a fluid communication between the clearances 67 and 67*a* and the swash plate chamber 55. Some of the through-bores 62 and 62*a* into which the long screw bolts 64 are inserted are formed larger than the diameters of the screw bolts 64, and accordingly, axial suction passageways are provided with the combined cylinder blocks 50 and 51. (FIGS. 7 and 8) Similarly, ports for suction P are formed in the valve plates 60 and 61 and suction vales 76 and 77 in response to the suction passageways formed in the cylinder blocks 50 and 51. Accordingly, the suction passageways are communicated with the scution chambers 74 and 75 of the front and rear housings 58 and 59. The refrigerant gas coming from an evaporator of the external climate control system is introduced into the swash plate chamber 55 via an inlet port 96 and the cut-away portions, and is further introduced into the suction chambers 74 and 75 of the front and rear housings 58 and 59, respectively, via the suction passageways. Then, the refrigerant gas is successively pumped into the respective cylinder bores 52 in response to the movement of the reed valves 76*a* and 77*a* of the front and rear suction valves 76 and 77 from a closed position toward an open position thereof. Arrows in broken lines indicate flow paths of the refrigerant in the compressor of FIG. 1.

As shown well in FIGS. 5 and 6, the front housing 59 is provided with a many-sided inner wall 82 projecting upwardly from the inside bottom surface thereof. The outer suction chamber 74 and the inner discharge chamber 68 are fluidly isolated from one another by the inner wall 82. The discharge chamber 68 is arranged between the inner wall 82 and a boss 87 formed in the inside surface of the front housing 58. The inner wall 82 confronts the front valve plate 60 (i.e., a valve assembly having the front discharge valve, a gasket, the front valve plate and the front suction valve), and is used for holding the valve assembly between the inner wall 82 and one end of the combined cylinder blocks 50 and 51. A transferring discharge port 91 is formed extending from the inner wall 82 at a portion thereof.

The rear housing 59 is provided with a many-sided inner wall 83 projecting upwardly from the inside bottom surface thereof. The outer suction chamber 75 and the inner discharge chamber 69 are fluidly isolated from one another by the inner wall 83. The discharge chamber 69 is arranged between the inner wall 83 and a boss 88 formed in the inside surface of the rear housing 69. The inner wall 83 confronts the rear valve plate (i.e., a valve assembly having the rear discharge valve, a gasket, the rear valve plate and the rear suction valve), and is used for holding the valve assembly between the inner wall 83 and the other end of the combined cylinder blocks 50 and 51. An extended portion 93 is formed extending from the inner wall 83 at a portion thereof. The discharge chamber 69 of the rear housing 59 is provided with a discharge conduit 89 for delivering the compressed refrigerant gas discharged into the discharge chamber 69 toward the external climate control system. The discharge conduit 89 extends by a certain length in the discharge chamber, and one end thereof is communicated with an outlet chamber 92.

Now, referring to FIGS. 4 to 8, when the compressor is in operation, the drive shaft 65 is rotated by the electromagnetic clutch 41, and the swash plate 54 is also rotated together so as to cause the reciprocation of the double-headed pistons 53 in the respective cylinder bores 52. Further, the refrigerant gas introduced through the inlet port 96 from the external climate control system is introduced into the swash plate chamber 55 via the cut-away portions, and is further introduced into the suction chambers 74 and 75 via the suction passageways. During the reciprocation of the double-headed pistons 53, the refrigerant gas passes into the respective cylinder bores 52 through the suction ports 78 and 79 in response to the movement of the reed-valves 76*a* and 77*a* of the front and rear suction valves 76 and 77 from the closed position toward the open position. After completion of the suction of the refrigerant gas into the cylinder bores 52, the respective pistons 53 compress the refrigerant gas within the cylinder bores to thereby increase pressure of the refrigerant gas, and accordingly, the reed-valves 70*a* and 71*a* of the front and rear discharge valves 70 and 71 are opened by the increased pressure of the refrigerant gas, and the compressed refrigerant gas is discharged from the respective cylinder bores 52 into the discharge chambers 68 and 69. The compressed refrigerant gas discharged into the discharge chamber 68 of the front housing 58 is carried into the outlet chamber 92 of the rear housing via the transferring discharge port 91 and discharge passageway 90 formed in the cylinder blocks 50 and 51. The outlet chamber 92 is communicated with a discharge outlet 98 so as to deliver the compressed refrigerant gas carried from the discharge chamber 68 of the front housing 58 toward the external climate control system.

In the reciprocating piston type refrigerant compressor provided with the above-described construction, it should be understood that the volume of the discharge chamber 68 of the front housing 58 is identical with that of the discharge chamber 69 of the rear housing 59. More preferably, the sum of volumes of the discharge chamber 68 of the front housing 58 and the discharge passageway 90 should be the same as the sum of volumes of the discharge chamber 69 of the rear housing 59 and the discharge conduit 89.

The discharge conduit 89 formed in the rear housing 59 may have any length within the discharge chamber 69 as long as it passes the compressed refrigerant gas into the outlet chamber 92, and is placed on the same line on which the outlet chamber 92 and the discharge outlet 98 are positioned. One end of the discharge conduit 89 is orthogonally communicated with the outlet chamber 92 and the other end thereof is communicated with the discharge chamber 69 so as to provide a fluid communication between the discharge chamber 69 and the outlet chamber 92.

Figure 9:
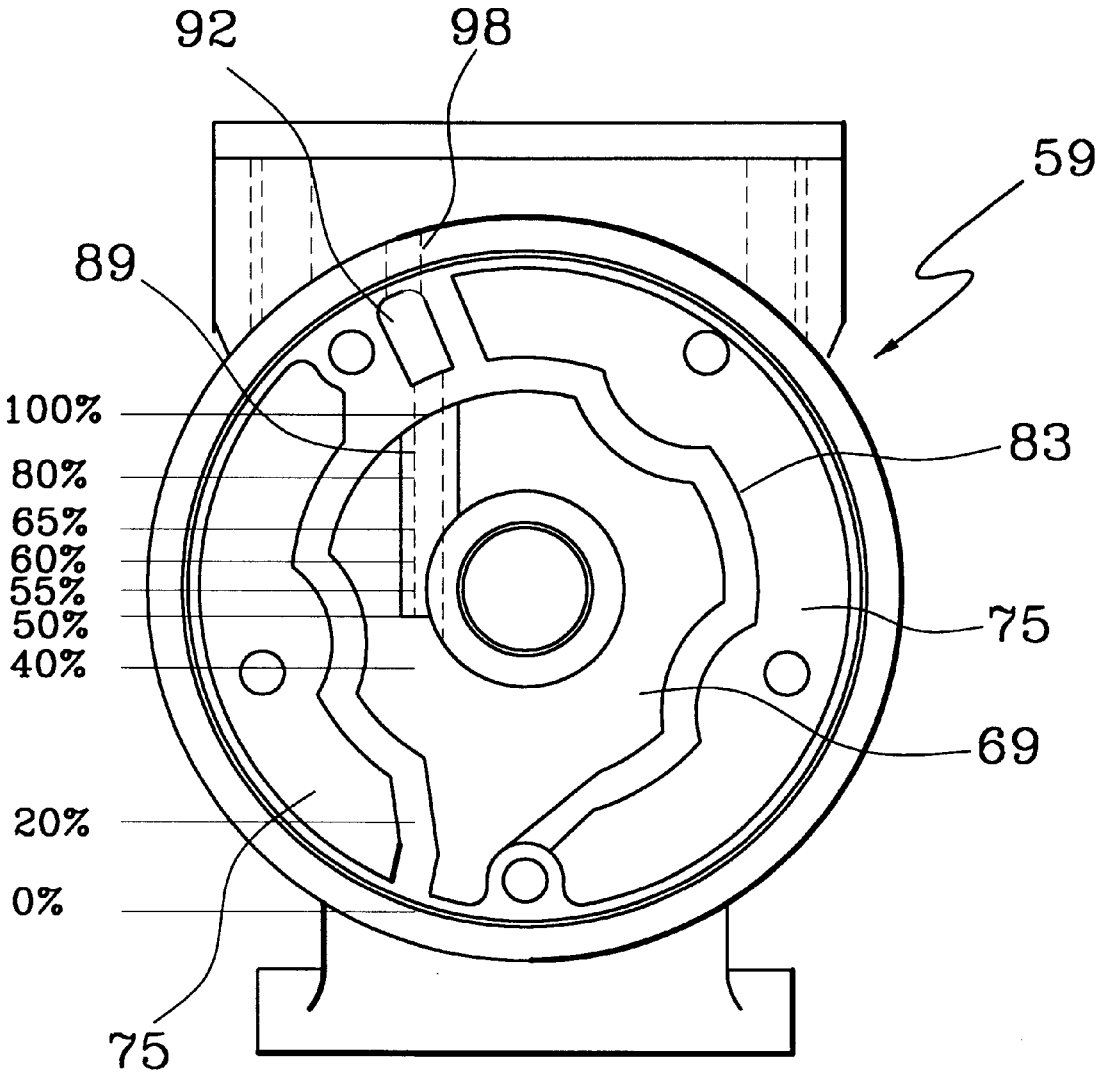
FIG. 9 is a front view of the rear housing of the compressor of FIG. 4, illustrating ratios of cutting a discharge conduit which is formed in the rear housing.

The length of the discharge conduit 89 is directly associated with noise due to the refrigerant gas pulsation, and the discharge conduit 89 extends to about half of the straight distance between a point on an interior surface of the inner wall 83, around which the outlet chamber 92 and the discharge conduit are comunicated with each other, and an oppostie point on the interior surface of the inner wall 83. In other words, with reference to the center line of the discharge conduit 89, when the distance L is defined as the length between two points B and A that are connected by the center line, as shown in FIGS. 6 and 9, how long the discharge conduit 89 extends may be determined in relation with L. As shown in FIGS. 6 to 12, when the discharge conduit 89 is half of L, the wave of the compressed refrigerant gas pulsation discharged into the discharge chamber 68 of the front housing 58 and the wave of the compressed refrigerant gas pulsation dicharged into the discharge chamber 69 of the rear housing 59 have substantially the same shape and almost opposite phase difference. Accordingly, two waves in the discharge chamber 68 of the front housing 58 and the discharge chamber 69 of the rear housing 59 almost cancel each other when they are superposed.

Figure 10:
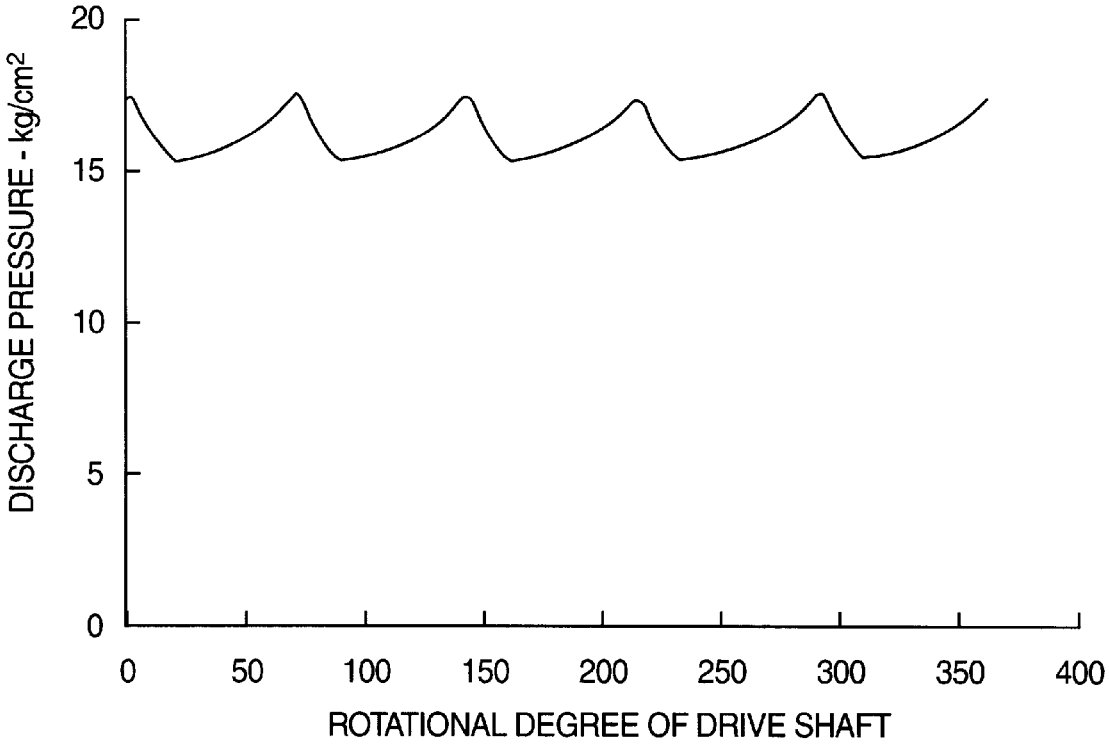
FIG. 10 is a graph indicating a wave form of refrigerant gas pulsations discharged into a discharge chamber of the front housing of the compressor of FIG. 4.
Figure 11:
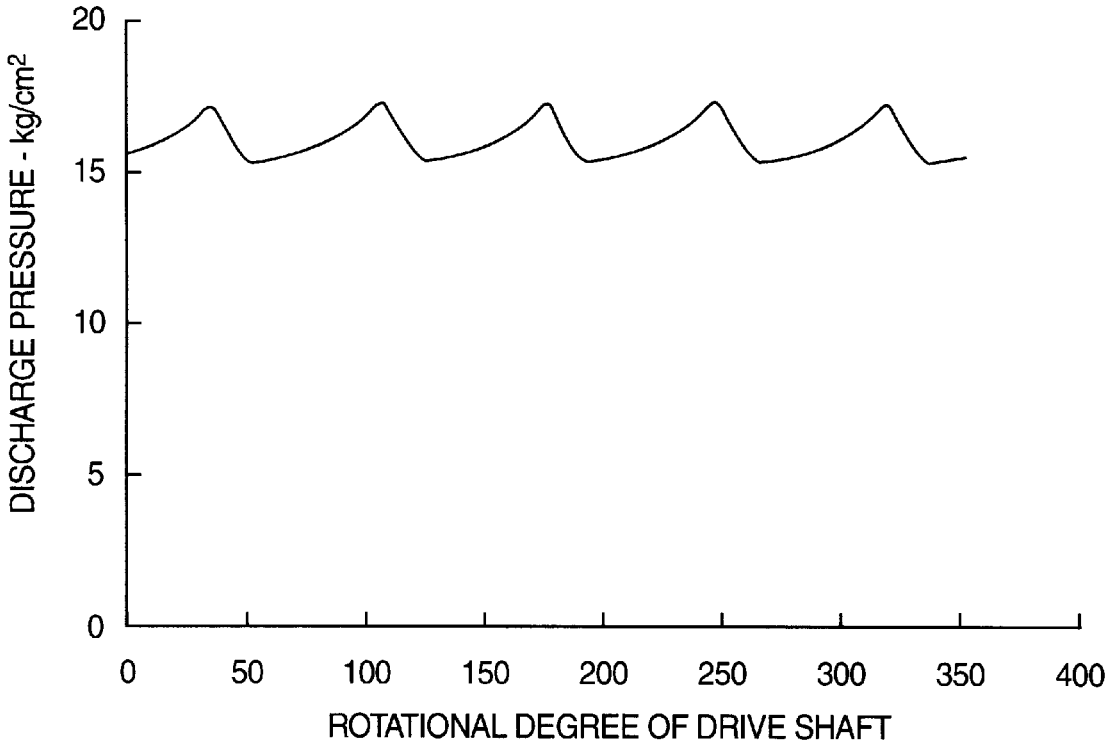
FIG. 11 is a graph indicating a wave form of refrigerant gas pulsations discharged into a discharge chamber of the rear housing of the compressor of FIG. 4.
Figure 12:
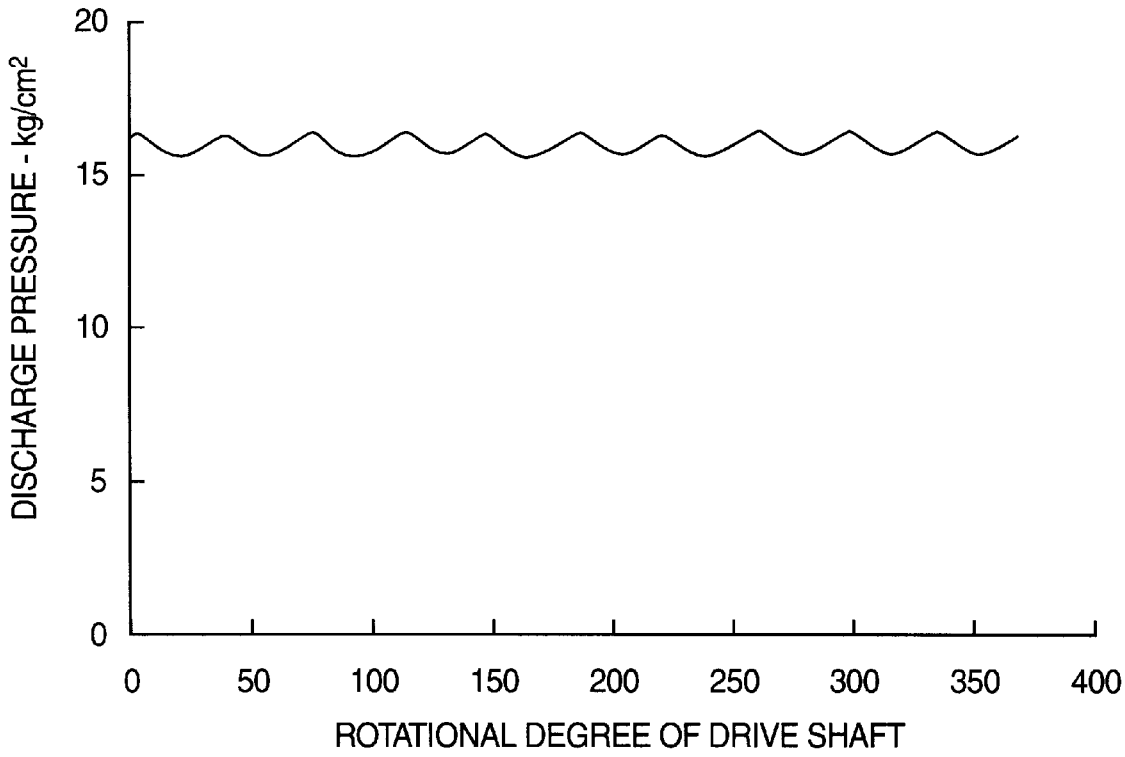
FIG. 12 is a graph indicating a wave form as displayed when two waveforms of FIGS. 9 and 10 overlap.

Referring to FIGS. 10 to 12, FIG. 10 shows the waveform of the compressed refrigerant gas pulstion discharged into the discharge chamber 68 of the front housing, and FIG. 11 indicates the waveform of the compressed refrigerant gas pulsation discharged into the discharge chamber 69 of the rear housing 59. Two waves have substantially the same shape but differ in phase by almost 180° so that the two combined waves are out of phase and their interference is destructive, and therefore, noise due to the refrigerant gas pulsation is effectively reduced. FIG. 12 shows that the two combined waves substantially cancel. The reason why the two waves cancel each other when they are superposed is that the sum of volumes of the discharge chamber 68 of the front housing 58 and the discharge passageway 90 is the same as the sum of volumes of the discharge chamber 69 and the discharge conduit 89 in the rear housing 59. Namely, when the reciprocating piston type compressor is in operation, the wave of the compressed refrigerant gas discharged in the discharge chamber 68 of the front housing 58 is different in phase by almost 1800° from the wave of the compressed refrigerant gas discharged in the discharge chamber 69 of the rear housing 59, since the suction into and discharge from the respective cylinder bores 52 are oppositely sequentially performed. The refrigerant gas discharged into the discharge chamber 68 of the front housing 58 is carried into the outlet chamber 92 in the rear housing 59 via the discharge passageway 90, at this time, the carried refrigerant gas is mixed in the outlet chamber 92 with the refrigerant gas delivered from the discharge chamber 69 of the rear housing 59 into the outlet chamber 92 via the discharge conduit 89 so as to cancel two refrigerant gas pulsation waves with each other.

Further, in the reciprocating piston type compressor, the amount of the compressed refrigerant gas which is discharged from the resepective cylinder bores 52 into the respective discharge chambers 68 and 69 of the front and rear housings 58 and 59 in response to the reciprocation of the double-headed pistons 53 are identical. Therefore, the amount of the refrigerant gas carried into the outlet chamber 92 of the rear housing 59 via the discharge conduit 89 is substantially the same as that of the refrigerant gas transferred from the discharge chamber 68 of the front housing 58 into the outlet chamber 92 via the transferring discharge port 91 and the discharge passageway 90. During the operation of the compressor, balance in the amounts of the refrigerant gas existing in the discharge chambers 68 and 69 is maintained.

Figure 13:
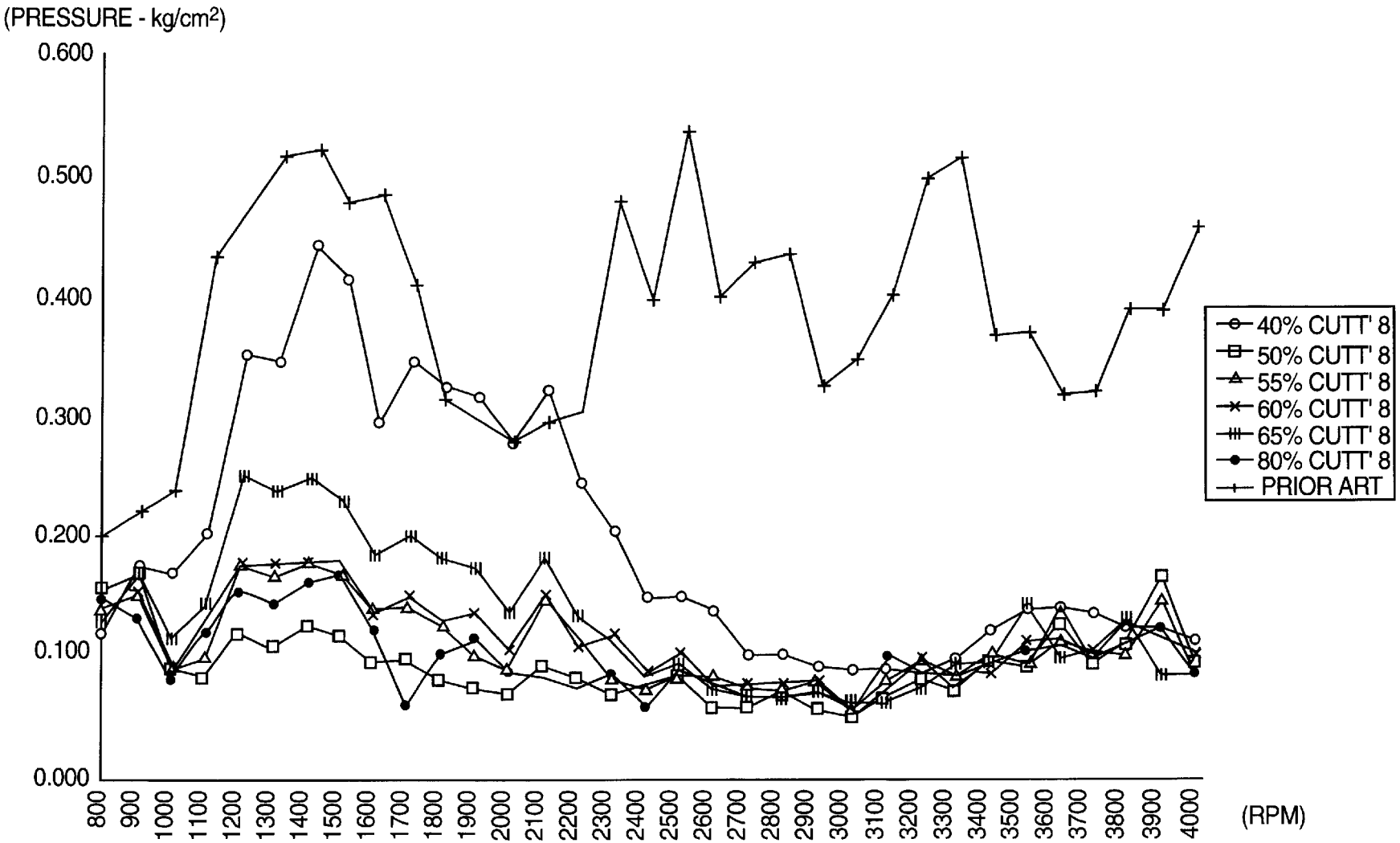
FIG. 13 is a graph of test results showing the relationship between the rotational speed of the compressor and the refrigerant gas pulsation pressure, depicted at ratios of cutting the discharge conduit.

FIG. 13 is a graph of test results showing the relationship between the rotational speed of the drive shaft, i.e., rpm and the refrigerant gas pulsation pressure, depicted at ratios of cutting the discharge conduit as shown in FIG. 9. FIG. 13 has been plotted based on the actual test data in which cutting ratio 0.0% represents the length of the discharge conduit 89 being L and cutting ratio 100% the length being zero. As indicated by reference number 100, the pulsation pressure of the refrigerant gas is lowermost when cutting the discharge conduit by 50% which is half of the length L. Comparing with the data of the prior art compressor, noise due to the refrigerant gas pulsation is effectively removed.

What is claimed is:

1. A reciprocating piston type compressor comprising:

a cylinder block having therein a central shaft bore and a plurality of cylinder bores arranged around said shaft bore;

a drive shaft rotatably supported in said shaft bore and supporting thereon a swash plate so as to be rotated together with said swash plate;

a plurality of pistons operatively engaged with said swash plate and reciprocating in said plurality of cylinder bores, respectively, to implement suction, compression, and discharge of a refrigerant gas in response to rotation of said drive shaft and said swash plate;

front and rear valve plate means for covering the ends of said cylinder bores at both ends of said cylinder block and having a plurality of suction ports and a plurality of discharge ports for sucking the refrigerant gas into and discharging the refrigerant gas from said cylinder bores, respectively;

a front housing closing one end of said cylinder block, said front housing having an inner wall defining a front discharge chamber for receiving compressed refrigerant gas discharged from said plurality of cylinder bores through said plurality of discharge ports formed in said front valve plate means, and said inner wall and an interior surface defining a front suction chamber for receiving the refrigerant gas to be compressed through said plurality of suction ports formed in said front valve plate means;

a rear housing closing the other end of said cylinder block, said rear housing having an inner wall defining a rear discharge chamber for receiving compressed refrigerant gas discharged from said plurality of cylinder bores through said plurality of discharge ports formed in said rear valve plate means, said inner wall and an interior surface defining a rear suction chamber for receiving the refrigerant gas to be compressed through said plurality of suction ports formed in said rear valve plate means, a discharge conduit disposed within said rear discharge chamber for delivering the compressed refrigerant gas discharged into said rear discharge chamber, and an outlet chamber for receiving and discharging the compressed refrigerant gas carried from said discharge chamber of said front housing through a discharge passageway formed in said cylinder block and communicating with said discharge conduit;

front suction and discharge valve means for providing a refrigerant gas communication between said front suction and discharge chambers of said front housing and said cylinder bores, said front suction and discharge chambers of said front housing and said cylinder bores, said front suction and discharge valve means having a plurality of movable suction and discharge reed valves and arrange with said front valve plate means between said cylinder block and said front housing;

rear suction and discharge valve means for providing a refrigerant gas communication between said rear suction and discharge chambers of said rear housing and said cylinder bores, said rear suction and discharge valve means having a plurality of movable suction and discharge reed valves and arranged with said rear valve plate means between said cylinder block and said rear housing;

wherein a sum of volumes of said front discharge chamber of said front housing and said discharge passageway is the same as a sum of volumes of said rear discharge chamber of said rear housing and said discharge conduit so that a wave of the compressed refrigerant gas pulsation discharged into said front discharge chamber of said front housing and a wave of the compressed refrigerant gas pulsation discharged into said rear discharged into said rear discharge chamber of said rear housing have a phase difference by almost 180°; and wherein said discharge conduit is orthogonally communicated with said outlet chamber so that the two discharge gas pulsation waves cancel each other in said outlet chamber so as to substantially remove noise due to refrigerant gas pulsation.

2. A reciprocating piston type compressor according to claim 1 wherein said discharge conduit extends to about half of a straight distance, said straight distance being defined by an elongated center line of said discharge conduit which connects a point on an interior surface of said inner wall at which said outlet chamber and said discharge conduit being communicated with each other and an opposite point on the interior surface of said inner wall.

3. A reciprocating piston type compressor comprising:

a cylinder block having therein a central shaft bore and a plurality of cylinder bores arranged around said shaft bore;

a drive shaft rotatably supported in said shaft bore and supporting thereon a swash plate for rotation with said drive shaft;

a plurality of pistons operatively engaging said swash plate and reciprocating in said plurality of cylinder bores, respectively, to provide for suction, compression, and discharge of a refrigerant gas in response to rotation of said drive shaft and said swash plate;

front and rear valve plates for covering the ends of said cylinder bores at both ends of said cylinder block and having ports for suction and discharge of the refrigerant gas;

a front housing closing one end of said cylinder block, said front housing having an inner wall defining a front discharge chamber for receiving compressed refrigerant gas discharged from said plurality of cylinder bores, and said inner wall and an interior surface defining a front suction chamber for receiving the refrigerant gas to be compressed;

a rear housing closing the other end of said cylinder block, said rear housing having an inner wall defining a rear discharge chamber for receiving compressed refrigerant gas discharged from other cylinder bores;

a discharge conduit disposed within said rear discharge chamber for delivering the compressed refrigerant gas discharged into said rear discharge chamber, an outlet chamber for receiving and discharging the compressed refrigerant gas carried from said discharge chamber through a discharge passageway formed in said cylinder block and communicating with said discharge conduit;

front suction and discharge valves for providing for refrigerant gas communication between said front suction and discharge chambers of said front housing and said cylinder bores; and rear suction and discharge valves for providing for refrigerant gas communication between said rear suction and discharge chambers of said rear housing and said cylinder bores:

wherein a sum of volumes of said front discharge chamber of said front housing and said discharge passageway is the same as a sum of volumes of said rear discharge chamber of said rear housing and said discharge conduit so that a wave of the compressed refrigerant gas pulsation discharged into said front discharge chamber of said front housing and a wave of the compressed refrigerant gas pulsation discharged into said rear discharged into said rear discharge chamber of said rear housing have a phase difference of approximately 180°; and wherein said discharge conduit is orthogonally communicated with said outlet chamber so that the two discharge gas pulsation waves cancel each other in said outlet chamber so as to substantially remove noise due to refrigerant gas pulsation.

4. A reciprocating piston type compressor according to claim 3, wherein said discharge conduit extends to about half of a straight distance, said straight distance being defined by an elongated center line of said discharge conduit which connects a point on an interior surface of said inner wall at which said outlet chamber and said discharge conduit being communicated with each other and an opposite point on the interior surface of said inner wall.

* * * * *